US005277010A

United States Patent [19]

Stephenson et al.

[11] Patent Number: 5,277,010

[45] Date of Patent: Jan. 11, 1994

[54] FLOORING SUPPORT

[75] Inventors: Debra A. Stephenson; Gary A. Stephenson, both of Mercer, Wis.; Michael J. Marzolf, Pheonix, Ariz.; Thomas W. Abendroth, Mercer, Wis.

[73] Assignee: Airthrust International, Inc., Mercer, Wis.

[21] Appl. No.: 986,875

[22] Filed: Dec. 4, 1992

Related U.S. Application Data

[63] Continuation of Ser. No. 708,669, May 31, 1991, abandoned.

[51] Int. Cl.[5] ..... E04B 5/02; E04F 15/22

[52] U.S. Cl. ..... 52/403; 52/480; 52/508

[58] Field of Search ..... 52/403, 479, 480, 508, 52/393

[56] References Cited

U.S. PATENT DOCUMENTS

| | | | |
|---|---|---|---|
| 997,842 | 7/1911 | Metzroth . | |
| 2,849,201 | 8/1958 | Schelgunov . | |
| 2,862,255 | 12/1958 | Nelson | 52/480 |
| 3,473,281 | 10/1969 | Omholt | 52/480 |
| 3,604,173 | 9/1971 | Dahlborg . | |
| 4,218,599 | 8/1980 | Garn . | |
| 4,396,177 | 8/1983 | Liebl . | |
| 4,860,516 | 8/1989 | Koller et al. | 52/480 |
| 4,879,857 | 11/1989 | Peterson et al. | 52/403 |
| 4,888,927 | 12/1989 | Yoshimi et al. | 52/480 |
| 4,890,434 | 1/1990 | Niese | 52/480 |
| 4,945,697 | 8/1990 | Ott et al. | 52/480 |

*Primary Examiner*—Michael Safavi

*Attorney, Agent, or Firm*—Michael, Best & Friedrich

[57] ABSTRACT

A flooring support system comprising a floor having an upper surface and a lower surface, a base surface, a floor support for supporting the lower surface of the floor in spaced relation above the base surface, the support including a resiliently compressible body having a first end surface engaged with the lower surface of the floor, a second end surface facing opposite the first end surface and engaged with the base surface, a central portion located intermediate the first and second end surfaces, and pneumatic spring means in the central portion for storing energy transferred through the floor to the body and for returning to the floor from the body substantially all energy transferred to the body through the floor, the pneumatic spring including a mechanism for affording resilient deflection of the first end surface toward the second end surface and pneumatic air cells for resisting deflection of the first surface toward the second surface.

13 Claims, 1 Drawing Sheet

FLOORING SUPPORT

This is a continuation of application Ser. No. 07/708,669, filed May 31, 1991, now abandoned.

BACKGROUND OF THE INVENTION

1. Technical Field

The invention relates generally to flooring systems, and particularly to flooring systems for providing a resilient surface.

2. Related Prior Art

Flooring systems for supporting a resilient floor or playing surface, e.g. a floor for athletic activity, such as basketball or gymnastics, or other physical activity, such as dancing, are known. One of the desirable characteristics of such flooring systems is the provision of a playing surface having superior traction. Another consideration in providing flooring system to support a resilient floor or playing surface, however, is the amount of resilient deflection or "give" provided by the floor in response to a downwardly directed force on the floor. This factor plays a significant role in determining the desirability of a particular flooring system.

In particular, it is undesirable for a flooring system to provide a playing surface which absorbs and dissipates a substantial amount of the energy transferred to the playing surface. Such a flooring system provides an undesirable "mushy" feel to those engaged in activity on the floor and tends to slow play. At the other extreme, it is also undesirable for a flooring system to provide a playing surface which does not adequately deflect in response to the force of an impact to the playing surface. Such a flooring system provides a playing surface without enough resilient deflection or "give", so that those engaging in activity on the playing surface receive the full shock of an impact on the playing surface.

In view of the foregoing, it is an object of the invention to provide a flooring system supporting firm and fast playing surface which resiliently deflects in response to the force of an impact on the playing surface.

Another object of the invention is to provide a flooring system supporting playing surface which resiliently responds to forces exerted on the playing surface and which subsequently returns to its original condition.

SUMMARY OF THE INVENTION

The invention provides a flooring system comprising a floor having an upper surface and a lower surface, a base surface, a flooring support including a body having a first end surface engaged with the lower surface of the floor, a second end surface engaged with the base surface, and pneumatic and structural means for affording resilient deflection of the first end surface toward the second end surface, the pneumatic and structural means including means for retaining a compressible fluid within the body.

The invention also provides a flooring support system comprising a floor having an upper surface and a lower surface, a base surface, a floor support for supporting the lower surface of the floor in spaced relation above the base surface, the support including a resiliently compressible body having a first end surface engaged with the lower surface of the floor, a second end surface facing opposite the first end surface and engaged with the base surface, a central portion located intermediate the first and second end surfaces, and pneumatic spring means in the central portion for storing energy transferred through the floor to the body and for returning to the floor from the body substantially all energy transferred to the body through the floor, the pneumatic spring means including structural means for affording resilient deflection of the first end surface toward the second end surface and pneumatic means for resisting deflection of the first surface toward the second surface.

The invention also provides a support for supporting a floor having an upper surface and a lower surface, the support supporting the lower surface above a base surface, the support comprising a body having a first surface adapted to engage the lower surface of the floor, a second surface integrally formed with the first surface and adapted to engage the base surface, and a central portion located intermediate the first and second end surfaces and having therein a plurality of recesses extending intermediate the first and second end surfaces and adapted to retain therein a compressible gas.

Figure 5:
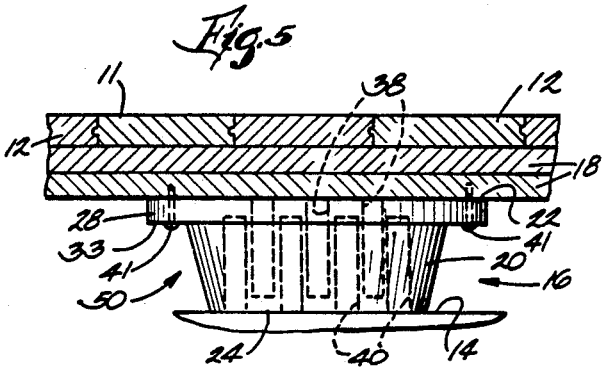
FIG. 5 is an elevation view of a portion of a flooring system embodying the invention.

Before one embodiment of the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE PREFERRED EMBODIMENT

Figure 1:
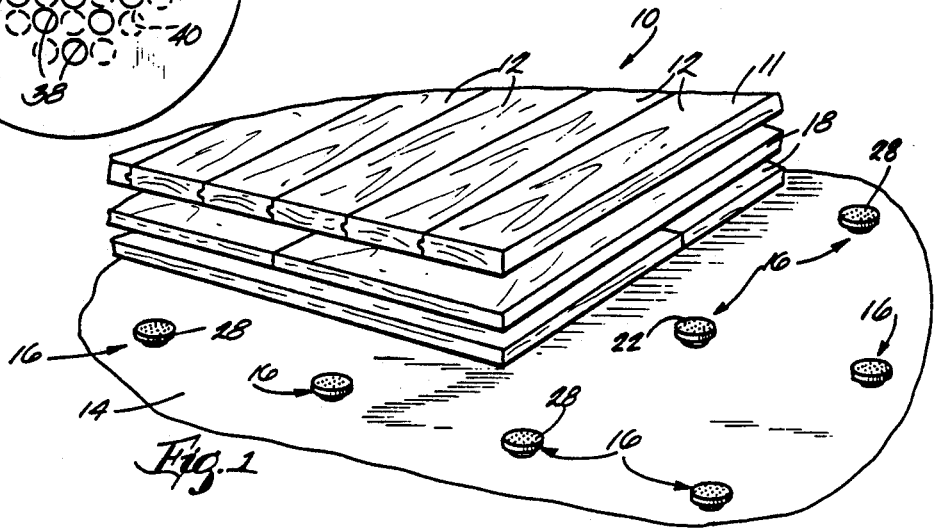
FIG. 1 is an exploded view of a flooring system embodying the invention.

Illustrated in FIG. 1 is a flooring system 10 well-suited for supporting a playing surface 11. In the illustrated arrangement, the playing surface 11 comprises a plurality of hardwood planks 12 which are resiliently supported above a solid base surface 14, such as a base of concrete. However, the flooring system 10 can be advantageously used to support various other types of materials providing a playing surface 11. A plurality of floor supports 16 evenly distributed on the base surface 14 support a subfloor 18 which underlies the plurality of planks 12. In the illustrated construction, the subfloor 18 comprises two layers of material, each layer including a plurality of relatively wide members, such as wood panels. Preferably, plywood is used for the subfloor 18. As shown in FIG. 5, the floor supports 16 hold the lower surface of the subfloor 18 in spaced relation above the base surface 14.

Figure 6:
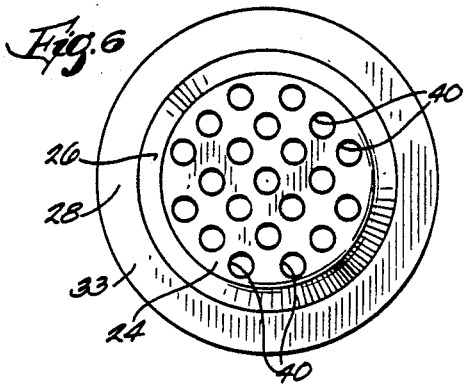
FIG. 6 is a bottom view of the floor support shown in FIG. 4.
Figure 2:
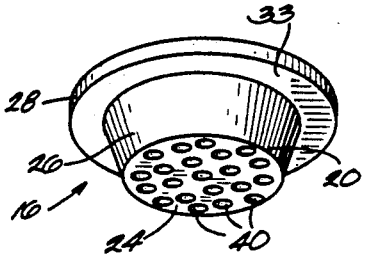
FIG. 2 is a perspective view of a flooring support incorporated in the flooring system illustrated in FIG. 1.
Figure 4:
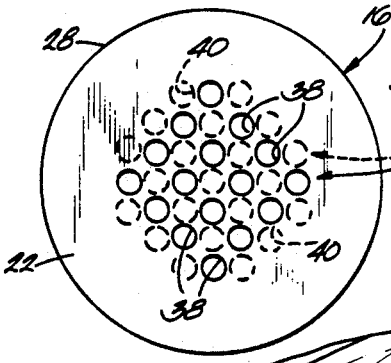
FIG. 4 is a top view of the floor support shown in FIG. 2.

Each floor support is made of a resiliently compressible, rubber-like material. Preferably, each floor support 16 is made of natural rubber which provides superior flexibility characteristics and which does not become hard or brittle. Each floor support 16 provides a body 20 having a first, upper end surface 22 engaged with the lower surface of the subfloor 18, and a second, lower end surface 24 engaged with the base surface 14. More particularly, and as shown in FIGS. 2–5, the body 20 of each floor support includes a generally frustoconical central portion 26 located intermediate the first end surface 22 and the second end surface 24 and a generally cylindrical cap portion 28 which is located intermediate the central portion 26 and the first, upper end surface 22 and which is preferably integrally formed with the central portion 26. The central portion 26 of the floor support 16 preferably has (FIG. 3) a relatively solid, frustoconical peripheral section 30 surrounding an interior section 32. As shown in FIGS. 5 and 6, the central portion 26 has a first diameter adjacent the second end surface 24 and a second diameter adjacent the cap portion 28 of the body 20 greater than the first diameter. Preferably, the cap portion 28 has a third diameter which is larger than the second diameter and which provides a generally annular flange 33 extending outwardly of the central portion 26.

Figure 3:
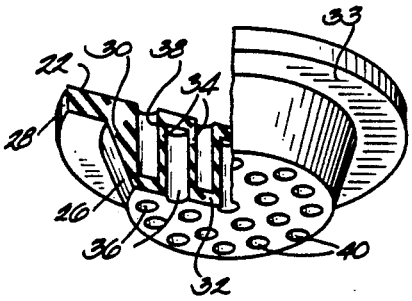
FIG. 3 is a view similar to FIG. 2 illustrating the floor support with a portion cut away for the purposes of illustration.

The body 20 also includes, as clearly shown in FIGS. 3 and 5, a plurality of relatively thin, imperforate, vertically extending walls 34 which extend laterally across the cylindrical cap portion 28 and across the interior section 32 between the frustoconical peripheral section 30 of the central portion 26. The plurality of thin walls 34 define therebetween a plurality of vertically extending spaced recesses or voids 36 in the interior section 32 of the central portion 26 and in the base portion 28. A first plurality of the recesses 38 open upwardly to the lower surface of the subfloor 18 and extend from the upper, first end surface 22 downwardly toward the second, lower end surface 24. A second plurality of the recesses 40 open downwardly to the base surface 14 and extend from the second, lower end surface 24 upwardly toward the first, upper end surface 22. The first and second pluralities 38, 40 of downwardly and upwardly opening recesses are separated by the thin walls 34 and do not communicate.

As the material from which the body 20 of the floor support 16 is made is a resilient, rubber-like material, the floor support 16 affords deflection of the first end surface 22 toward the second end surface 24. Also, due to the voids in the central portion 26 created by the recesses 36, and due to the relatively slender vertical profile of the thin walls 34, when the floor support 16 alone is subjected to compressive forces, the interior section 32 of the central portion 26 is relatively easy to compress. While the interior section 32 of the central portion 26 is relatively easy to compress, the outer, peripheral section 30 of the floor support 16 is relatively solid and, therefore, does not deflect as easily as the interior section 32.

When assembled, the floor supports 16 are fastened to the lower surface of the subfloor 18 by fasteners 41 such as staples extending through the flange 33 of the cap portion 28 and into the subfloor 18.

The flooring system 10 also provides pneumatic and structural means 50 for affording resilient deflection of the first end surface 22 toward the second end surface 24 in response to a downwardly directed impact on the upper playing surface 11. While various other constructions could be used, in the illustrated construction, the pneumatic and structural means 50 includes means for affording deflection of the first end surface 22 toward the second end surface 24 and means for retaining a compressible gas within the body 20 of the floor support 16 so that the floor support 16 resists deflection of the first end surface 22 toward the second end surface 24.

More specifically, when assembled, the plurality of recesses 36 are filled with compressible gas or air. The flooring system 10 provides, when assembled, means for retaining the air in the recesses 36 during impact on the playing surface 11. The means for retaining the air in the recesses 36 during impact on the playing surface 11 includes the engagement between the first, upper end surface 22 of the floor support 16 and the lower surface of the subfloor 18. The means for retaining air in the body 20 of the floor support 16 also includes the engagement between the second, lower end surface 24 of the floor support 16 and the base surface 14. Due to the resiliently flexible construction of the floor support 16, and due to the weight of the planks 12 and subfloor 18 when the planks 12 and subfloor 18 overlie the upper end surface 22 of the floor supports 16 and when the lower end surface 24 of the floor support 16 engages the base surface 14, the air in the recesses 36 is substantially retained within the central portion 26 of the body 20. Furthermore, the connection of the floor supports 16 with the subfloor 18 by fasteners extending through the flange portion 33 contributes to the retention of air in the upwardly opening recesses 38. When under the influence of a force tending to deflect the first end surface 22 toward the second end surface 24 the recesses 36 are substantially sealed closed by the respective engagement between the first and second end surfaces 22, 24 and the subfloor 18 lower surface and the base surface 14. When so substantially sealed, the air cells defined by the recesses 36, the subfloor 18 and the base surface 14 act as pneumatic springs resisting deflection of the first end surface 22 toward the second end surface 24.

When, during the course of activity on the playing surface 11, the playing surface 11 receives a downwardly directed impact, forces are transferred through the playing floor and through the subfloor 18 to the floor support 16. Due to relatively limited deflection of the peripheral section 30 of the floor support 16 and due to the deflection of the thin walls 34 of the central portion 26, the first end surface 22 of the floor support 16 deflects slightly downwardly toward the second, lower end surface 24 consequent to downward loading. The floor support 16 thus affords limited deflection of the first end surface 22 toward the second end surface 24. The floor support 16 also deflects downwardly against the pneumatic resistance provided by the air cells or sealed recesses 36. As the first end surface 22 deflects downwardly toward the second end surface 24, the energy transferred through the floor to the floor support 16 is momentarily stored in the floor support 16. Due primarily to the resiliency of the compressed air in the recesses 36 and, to a limited extent, due to the resilient material used for the floor support 16, substantially all of the energy transferred to the floor support 16 is returned to the playing surface 11 so that the playing surface 11 returns to its original condition. Thus, the flooring system 10 supports the playing surface 11 and resiliently deflects in response to an impact on the playing surface 11 yet provides a playing surface 11 which feels "quick" and which is not "mushy." The flooring system 10 thus also provides a floor support 16 including pneumatic spring means for storing energy transferred through the floor to the floor support 16 and for returning to the floor from the floor support 16 substantially all the energy transferred to the floor support 16 through the floor.

Various other features of the invention are set forth in the following claims:

We claim:

1. A flooring support system comprising a wood floor having an upper surface and a lower surface, a base surface, a floor support for supporting said lower surface of said floor in spaced relation above said base surface, said support including a plurality of discrete, resiliently compressible bodies spaced from each other in a first direction and from each other in a second direction generally perpendicular to said first direction, said bodies each including a first end surface engaged with said lower surface of said floor, a second end surface engaged with said base surface and spaced from said first surface at a given height, a central portion located intermediate said first and second end surfaces, and a plurality of vertically extending recesses extending from one of said end surfaces and into said central portion for a distance more than fifty percent of said given height.

2. A system as set forth in claim 1 wherein said plurality of recesses includes a plurality of upwardly opening recesses extending from said first end surface.

3. A system as set forth in claim 1 wherein said plurality of recesses includes a plurality of downwardly opening recesses extending from said second end surface.

4. A system as set forth in claim 1 wherein said bodies have a frustoconical portion located intermediate said first and second end surfaces, and a cylindrical portion integrally formed with said frustoconical portion and located intermediate said frustoconical portion and said first end surface.

5. A system as set forth in claim 4 wherein said frustoconical portion includes a peripheral wall having a first diameter adjacent said second end surface, a second diameter adjacent said cylindrical portion greater than said first diameter, and wherein said cylindrical portion includes a peripheral wall having a third diameter larger than said second diameter.

6. A flooring assembly as set forth in claim 1 wherein said plurality of recesses includes a first plurality of upwardly opening recesses extending from said first end surface and having respective inner ends and a second plurality of downwardly opening recesses extending from said second end surface and having respective inner ends located between said first end surface and said inner ends of said upwardly opening recesses.

7. A system in accordance with claim 1 wherein said bodies have a frustoconical portion located intermediate said first and second end surfaces, and a cylindrical portion integrally formed with said frustoconical portion and located intermediate said frustoconical portion and said first end surface.

8. A support for supporting a floor having an upper surface and a lower surface, said support supporting the lower surface above a base surface, said support comprising a body having a first end surface engaging the lower surface of the floor, a second end surface integrally formed with said first end surface, engaging the base surface, and being spaced from said first surface at a given distance, and a central portion located intermediate said first and second end surfaces and having therein a plurality of recesses communicating with one of said first and second end surfaces, extending in said central portion for a distance more than fifty percent of said given distance, and separated by thin imperforate walls.

9. A support as set forth in claim 8 wherein said first and second end surfaces are generally planar.

10. A support as set forth in claim 9 wherein said plurality of recesses includes a plurality of upwardly opening recesses extending from said first end surface of said body.

11. A support as set forth in claim 9 wherein said plurality of recesses includes a plurality of downwardly opening recesses extending from said second end surface of said body.

12. A support in accordance with claim 8 wherein said body has a frustoconical portion located intermediate said first and second end surface, and a cylindrical portion integrally formed with said frustoconical portion and located intermediate said frustoconical portion and said first and second end surfaces.

13. A support in accordance with claim 12 wherein said frustoconical portion includes a peripheral wall having a first diameter adjacent said second end surface, a second diameter adjacent said cylindrical portion greater than said first diameter, and wherein said cylindrical portion is located adjacent said first end surface and includes a peripheral wall having a third diameter larger than said second diameter.

* * * * *